United States Patent [19]

Balbo

[11] 4,058,191

[45] Nov. 15, 1977

[54] ELEVATOR SYSTEM INCLUDING AN ELEVATOR CAR HAVING DOOR OPERATED SEALING DEVICES ADJACENT DOOR OPENING

[75] Inventor: Anthony M. Balbo, Millburn, N.J.

[73] Assignee: Westinghouse Electric Corporation, Pittsburgh, Pa.

[21] Appl. No.: 729,919

[22] Filed: Oct. 6, 1976

[51] Int. Cl.[2] ..... B66B 11/00

[52] U.S. Cl. ..... 187/1 R; 49/303

[58] Field of Search ..... 187/1 R, 3, 4, 5, 6, 187/51, 52 R, 52 LC, 56, 98; 49/303, 304, 310, 315

[56] References Cited

U.S. PATENT DOCUMENTS

| | | | |
|---|---|---|---|
| 1,021,172 | 3/1912 | Widmann et al. | 187/1 R |
| 1,406,951 | 2/1922 | Fehr | 187/1 R |
| 2,739,354 | 3/1956 | Pope | 187/98 |
| 3,066,761 | 12/1962 | Behrens et al. | 187/1 R |
| 3,734,238 | 5/1973 | Secresty et al. | 187/1 R |

*Primary Examiner*—Evon C. Blunk
*Assistant Examiner*—James L. Rowland
*Attorney, Agent, or Firm*—D. R. Lackey

[57] ABSTRACT

An elevator system including an elevator car mounted for movement adjacent to an external wall of the building. Precipation and rain shield members automatically close the running space between the elevator car and building car responsive to opening movement of the elevator car doors. Closing movement of the elevator car doors return the shield members to retracted positions.

8 Claims, 8 Drawing Figures

ELEVATOR SYSTEM INCLUDING AN ELEVATOR CAR HAVING DOOR OPERATED SEALING DEVICES ADJACENT DOOR OPENING

BACKGROUND OF THE INVENTION

1. Field of the Invention

The invention relates in general to elevator systems, and more specifically to elevator systems in which the elevator car is mounted for movement adjacent the external wall of a building.

2. Description of the Prior Art

Certain types of elevator installations require that the opening between the car and entranceway to a floor, necessary to provide running clearance between the elevator car and associated hoistway wall, be sealed when the car door is opened. For example, U.S. Pat. Nos. 1,021,172 and 1,406,951 are directed to elevator constructions suitable for cold storage warehouses, which construction prevents cold air from a floor from excaping into the elevator shaft when the elevator car and hoistway doors are opened.

U.S. Pat. No. 1,021,172 discloses a rectangular frame carried by the elevator car which is manually projected via a lever arrangement to contact the hoistway wall. The lever, when operated to advance the frame, opens a switch in the drive motor circuit to prevent the elevator car from being operated until the frame is retracted and the switch is closed.

U.S. Pat. No. 1,406,951 discloses an automatic sealing arrangement which requires that the wall about each hoistway door be modified to include elements which cooperate with elements carried by the elevator car to effect the desired seal. The sides of the car are continuously sealed to the hoistway wall by vertically oriented rails fixed on either side of the hoistway openings which extend the length of the hoistway, each of which cooperate with a pair of spaced flexible strips carried by the elevator car which are biased against opposite sides of the associated rail. Horizontally extending cross members are fastened to the hoistway wall above and below each door opening. These cross members have a convex cross-sectional configuration and they cooperate with flexible strips mounted across the top and bottom of the elevator car to automatically provide upper and lower seals when the elevator car is in registry with the hoistway door. The elements of the side seals are in continuous sliding contact, and the elements of the top and bottom seals contact one another as the car passes each hoistway door, whether or not the elevator car stops at the associated hoistway door.

In recent years, elevators have been constructed to operate along an exterior wall of a building, and the normal running clearance provides a space for precipitation and wind to enter the elevator car and adjacent floor when the elevator car and hoistway doors are opened. U.S. Pat. No. 3,734,238 discloses an arrangement which requires that the exterior wall of the building be modified to include elements which cooperate with elements carried by the elevator car to provide a wind and rain shield or seal. Vertically oriented U-shaped elements are fixed to the exterior building wall, on each side of the hoistway openings, which cooperate with W-shaped members carried by the elevator car on each side of its door opening, to provide lateral seals. Magnetic plates are fastened to the exterior wall, above and below each hoistway opeing. Magnetic gaskets disposed above and below the elevator car door are electromagnetically retracted until the car stops and ceases leveling. Electromagnets are then de-energized and springs drive the magnetic gaskets against the magnetic plates to effect the upper and lower seals. Microswitches operated by the retractable upper and lower seals prevent operation of the elevator car when the upper and lower seals are in their extended positions.

While these prior art arrangements provide effective seals, it would be desirable to provide such a seal between an elevator car and the exterior wall of the building without requiring modification of the exterior wall, without requiring sliding components subject to wear, and without any auxiliary electrical circuits or auxiliary electrical interlocks. It would also be desirable to automatically provide such a seal only when the seal is necessary, i.e., when the elevator car is stopped and the car and hoistway doors are open to permit passanger transfer.

SUMMARY OF THE INVENTION

Briefly, the present invention is a new and improved elevator system suitable for travel adjacent the exterior wall of a building, which includes apparatus for automatically providing a precipitation and wind seal between the elevator car and building wall when the car and hoistway doors are open. The apparatus for effecting the seal is completely car mounted, requiring no modification to the adjacent wall of the building. Further, the operation of the seal apparatus does not depend upon the operation of an auxiliary electrical circuit, nor does it require any auxiliary electrical interlocks to prevent car movement when the seal is activated. Further, it does not utilize parts subject to wear because of continuous sliding contact.

The elevator system of the invention automatically actuates and terminates the seal in response to opening and closing movement, respectively, of the elevator car doors. The seal apparatus includes four pivotable shield members disposed on opposite sides, above and below the door openings of the elevator car, which are mechanically pivoted between extended and retracted positions by cooperative cam and cam follower arrangements which include one element on the elevator car door, or doors, and the other element on the associated shield member. Thus, the shield members are only operated to effect the seals when the car door starts to open, and the exact position of the car door, while opening, may be selected to operate each shield member. Thus, it is not necessary to include circuitry for detecting when the elevator car has stopped and is to open its doors, since this circuitry is already associated with the operation of the elevator car doors. Further, it is not necessary to provide auxiliary electrical circuits for operating the seal, as the operation is completely mechanical, operating from the energy of the moving car doors. It is also unnecessary to provide auxiliary electrical interlocks responsive to shield positions, as the door circuitry already includes such an interlock which prevents the elevator car from operating with its doors open. Each shield member of the invention includes a flexible, elastomeric portion or flap which contacts the wall of the building and allows slight movement of the elevator car, such as due to a change in car weight, without destroying the seal or damaging the components of the shield apparatus.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Figure 1:
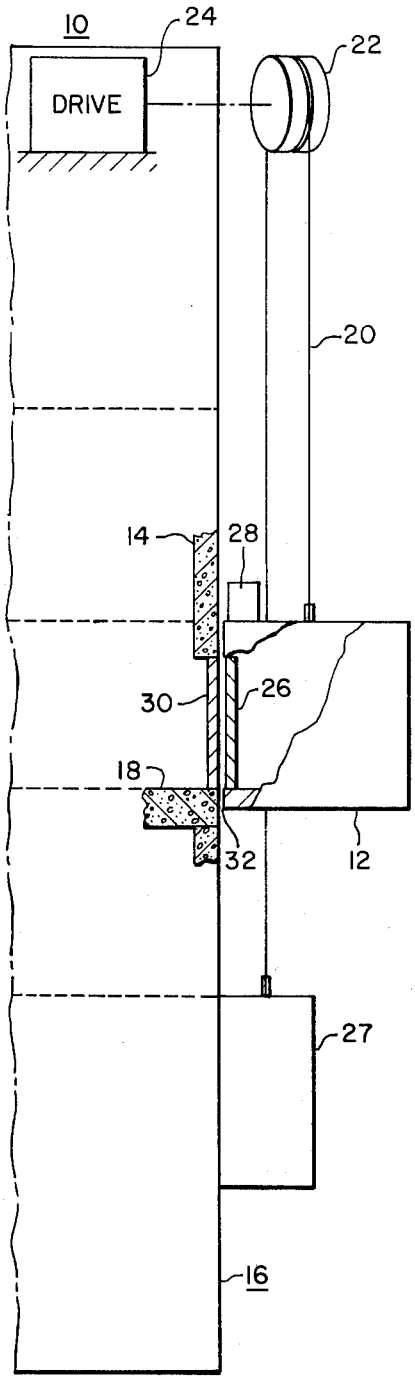
FIG. 1 is an elevational view of an elevator system of the type which may utilize the teachings of the invention.

Referring now to the drawings, and to FIG. 1 in particular, there is shown an elevator system 10 which may utilize the teachings of the invention. Elevator system 10 includes an elevator car 12 mounted for movement relative to the external wall 14 of a building 16 having a plurality of floors or landings, such as floor 18. The elevator car 12 is supported by a plurality of metallic cables or ropes, shown generally at 20, which are reeved over a traction sheave 22 mounted on the shaft of a drive motor 24. A counterweight 27 is connected to the other ends of the ropes 20.

The elevator car 12 includes an opening which faces the exterior wall 14 of the building 16, which opening is opened and closed by a door 26 in response to a door operator mechanism 28 linked thereto, which is mounted on top of the car 12.

Each floor of the building 16, such as floor 18, includes a hoistway door 30 which is closed and locked until the elevator car 12 is stopped adjacent to the door 30, at which time the hoistway door 30 is operated in unison with operation of the elevator car door 26, via a mechanical linkage which is well known in the art.

The elevator car 12 and its counterweight 26 are guided in their respective vertical travel paths by conventional guide rails (not shown) and guide roller assemblies mounted on the movable elements of the elevator system, which accurately control the running clearance or space 32 between the elevator car 12 and the exterior wall 14 of the building 16. While this running clearance is not large, it does provide an opening for wind and precipitation to contact passengers as they transfer between the floor and the elevator car, as well as to enter the car 12 and the building 16. Thus, some means for sealing this opening must be provided, and the present invention is directed to a new and improved elevator system which includes seaing means for automatically effecting such a seal.

Figure 2:
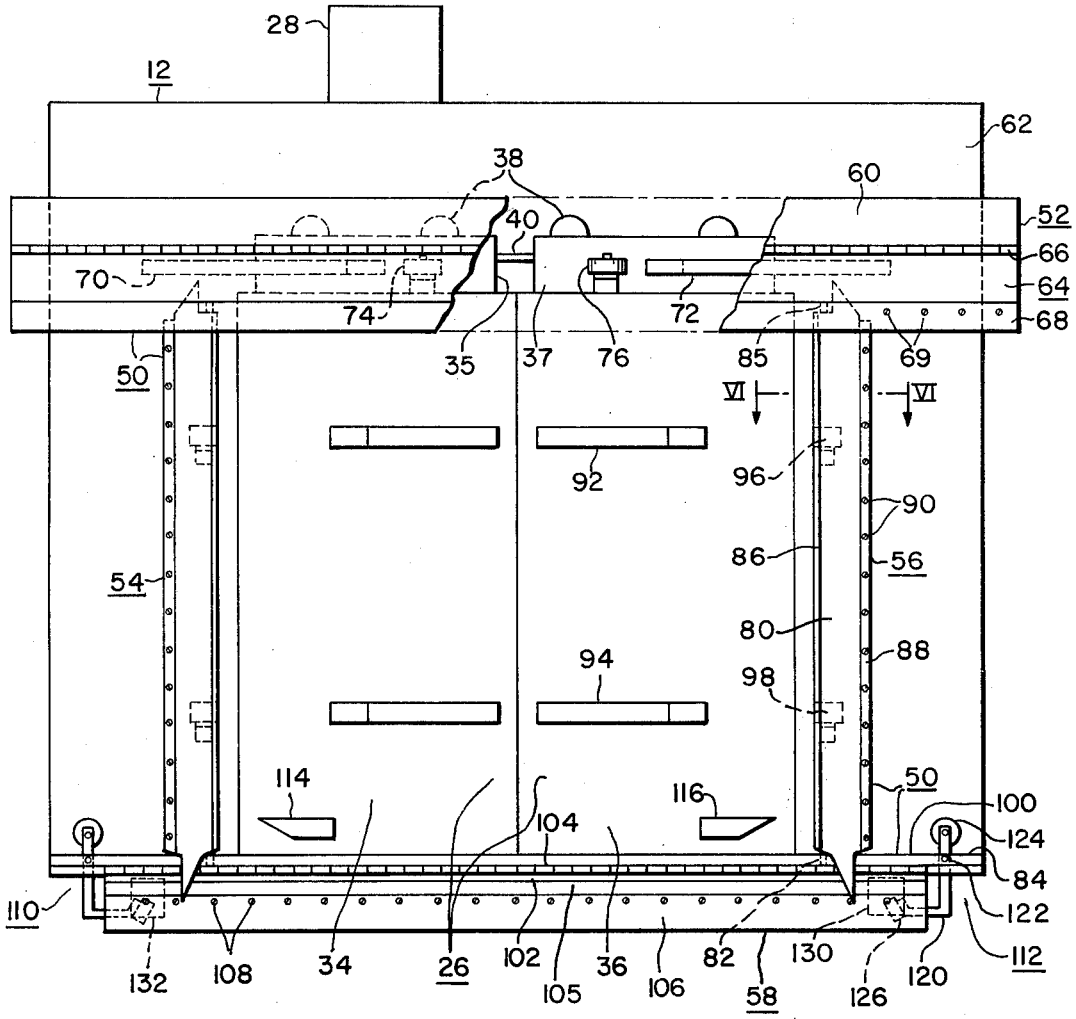
FIG. 2 is an elevational view of an elevator car constructed according to the teachings of the invention, viewed from the associated building, illustrating the elevator car with its doors in their closed position.
Figure 3:
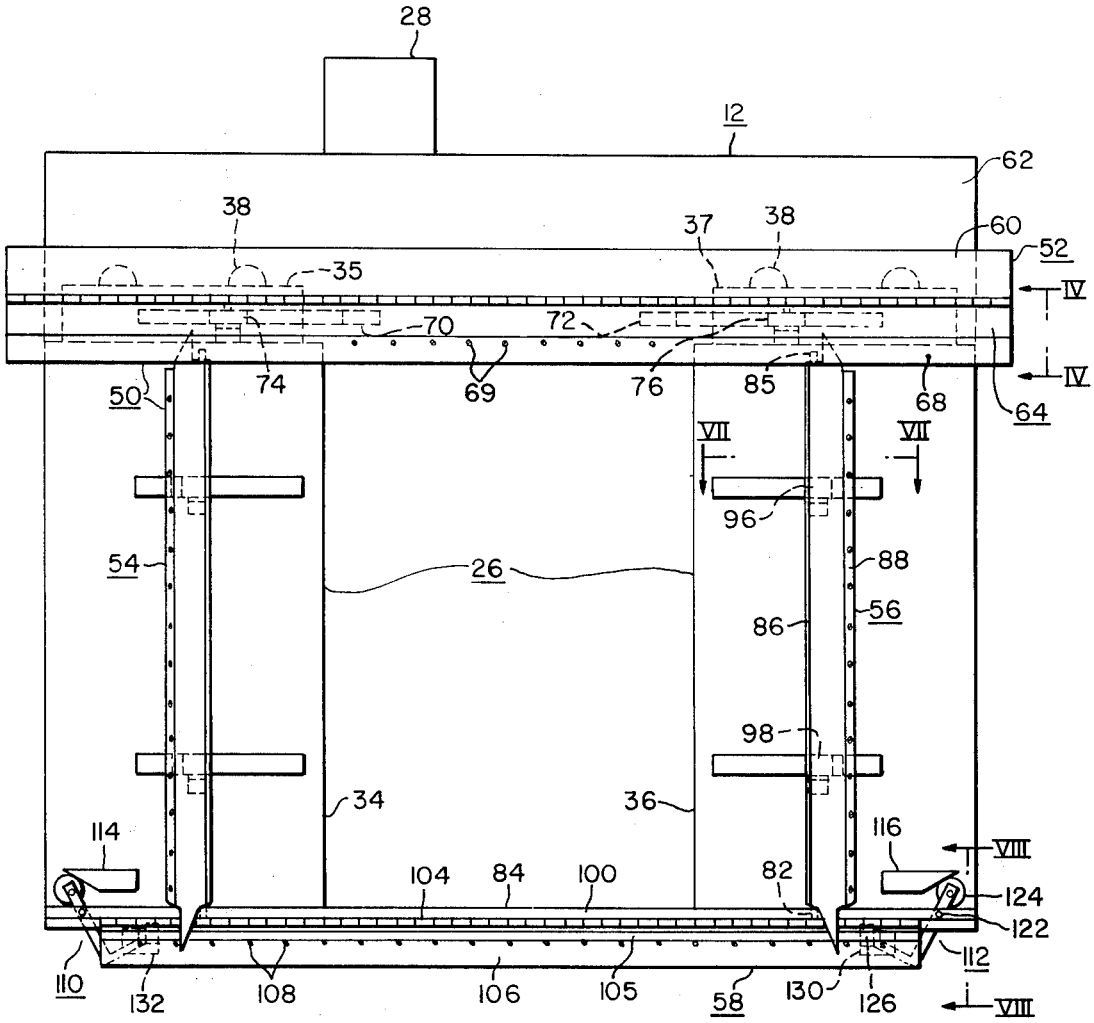
FIG. 3 illustrates the elevator car shown in FIG. 2, except with its doors open.

FIGS. 2 and 3 are elevational views of the elevator car 12, as viewed from the exterior wall 14 of the building 16, with the car doors 26 in their closed, and in their open positions, respectively. Elevator car 12, as illustrated in FIGS. 2 and 3, includes a sealing arrangement 50 constructed according to the teachings of the invention, which is entirely car mounted, requiring no modification to the exterior wall 14 of the building 16.

The car door 26, in this exemplary embodiment of the invention, is a center opening door having first and second movable door panels 34 and 36, respectively. Door panels 34 and 36 include door hanger plates 35 and 37, respectively, connected to the upper ends of the door panels. The hanger plates include a plurality of guide rollers 38 which engage a track 40 and support the door panels for guided movement transversely of the door opening in the car 12, to open and close the door opening in response to actuation by the door operator mechanism 28. The operating linkage between the door panels 34 and 36 and the door operator mechanism 28 is not illustrated, in order to simplify the drawings. Any conventional door operator mechanism and linkage arrangement may be used, such as that shown in U.S. Pat. No. 2,992,818 which is assigned to the same assignee as the present application.

The sealing apparatus or arrangement 50 includes first, second, third and fourth shield members 52, 54, 56 and 58, respectively, each pivotally mounted to the elevator car 12.

The first shield member 52 provides a seal above the car door opening, between the elevator car 12 and the exterior wall 14 of the building 16. The first shield member 52 includes a first elongated flat sheet metallic member 60 fixed to the elevator car 12 such as to a panel 62 of the door operator 28, and a depending second elongated flat sheet member 64 which is pivotally mounted to the first member 60 via a hinge 66 which has a horizontally disposed pivot axis. The first member 60 may simply be one leg of an elongated hinge, and the second member may include the second leg of the hinge along with a flat sheet metallic member connected thereto to provide the desired depending length dimension. The extreme outwardly extending end portion 68 of the second elongated member 64 is formed of a resilient, elastomeric material, such as rubber. The elastomeric end portion 68 may be attached to the second member 64 via a plurality of screws 69.

The back side of the second portion 64 of the first shield member 52, from the viewpoint of FIGS. 2 and 3, includes first and second elongated cam members 70 and 72, respectively, fixed thereto in predetermined spaced relation. The car door hanger plates 35 and 37 have rollers 74 and 76, respectively, rotatably fixed thereto which are spaced from cam members 70 and 72 when the door panels 34 and 36 are in their closed positions. The rollers 74 and 76 are oriented to strike the cams 70 and 72, respectively, as the door panels 34 and 36 start to open, gently raising or pivoting the second member 64. The cam members 70 and 72 are dimensioned to maintain the first shield member 52 in the extended or operated position from the time the door panels reach a predetermined point in the opening process, until the doors start to close and again reach this predetermined point. As illustrated in FIGS. 2 and 3, the rollers 74 and 76 contact the cams 70 and 72, respectively, early in the door opening cycle to almost immediately render the upper seal effective.

Figure 4:
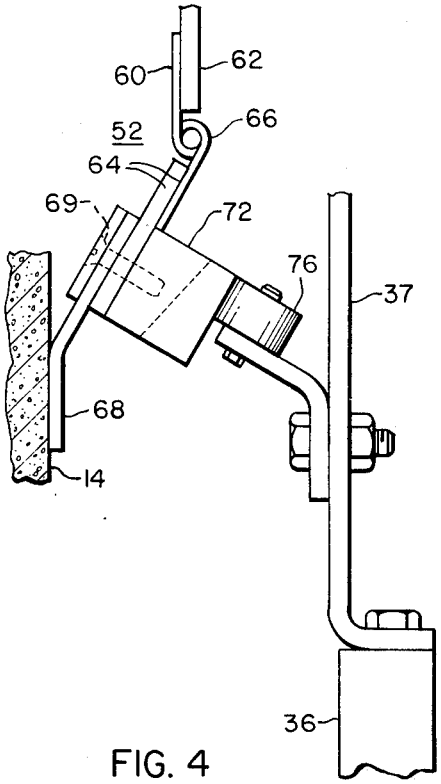
FIG. 4 is an elevational view of the upper shield member operated to its sealing or extended position, taken between and in the direction of arrows IV—IV of FIG. 3.
Figure 5:
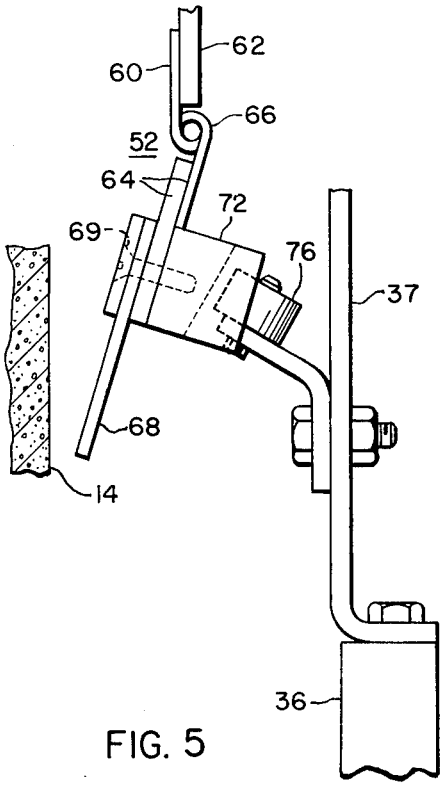
FIG. 5 is an elevational view of the upper shield member shown in FIG. 4, illustrated at a selected point during the closing of the elevator car doors.

FIG. 4 is an elevational view of the first shield member 52, taken between and in the direction of the arrows IV—IV in FIG. 3, illustrating the first shield member 52 in the operated or extended position, i.e., providing a precipitation and wind shield above the doorway entrance. It will be noted that the roller 76 is contacting the highest point of the cam 72, providing maximum pivotal extension, and that the elastomeric flap 68 of the shield member is stressed and thus deflected to include a flat portion disposed against the wall 14 of the building 16. FIG. 5 is a view of the first shield member 52, similar to the view of FIG. 4 except illustrating the shield member 52 during the door closing operation, with the roller 76 descending the inclined surface portion of cam 72 to allow the depending flap portion of the first shield member to pivotally retract and provide the desired running clearance. The depending flap portion of the first shield member 52 will drop by gravity as the roller descends the incline of the cam 72. However, the hinge construction may include suitable spring members (not shown) for biasing the depending flap portion towards the elevator car 12 and thus prevent the flap portion from moving due to wind currents as the elevator car travels up and down the side of the building 16.

The second and third shield members 54 and 56 provide lateral seals adjacent the left and right hand sides of the elevator car door opening, between the elevator car 12 and the exterior wall 14 of the building 16. Since the second and third shield members are of similar construction, only the third shield member 56 will be described in detail.

The third shield member 56 includes a flat elongated member which is pivotally mounted on a vertical pivot axis, and it is biased towards the elevator car 12 via suitable spring members (not shown). For example, the third shield member 56 may include a flat metallic central portion 80 which includes a lower pivot pin 82 mounted in the car sill 84, and an upper pivot pin 85 supported by a suitable bracket (not shown). The inner vertically oriented edge of the central portion 80, i.e., the edge which is nearest the vertical pivot axis, may include an elastomeric nose 86 disposed thereon, which, when the shield member is pivoted outwardly away from the elevator car 12 will contact the associated door panel when it reaches its maximum extension to provide a seal between the shield member and the elevator car door. The outer vertically oriented edge of the central portion 80 includes an elastomeric flap 88 suitable secured to the central portion 80, such as by a plurality of screws 90. The elastomeric flap 88 contacts the wall 14 of the building 16 when the third shield member is operated to its extended or sealing position.

The car door panel 36 includes cam members mounted on the side facing the building, such as first and second vertically spaced cam members 92 and 94. Rollers 96 and 98 for contacting cam members 92 and 94, respectively, are suitably fixed to the metallic member 80 of the third shield member 56. The cam members 92 and 94 are dimensioned and spaced from the rollers 96 and 96, respectively, such that when the door panel 36 reaches a predetermined point in the opening sequence or cycle, the rollers contact their associated cam members and pivot or flip the third shield member outwardly to effect the lateral seal. In a preferred embodiment, the second and third shield members are actuated after the first shield member during the door opening cycle, and before the first shield member during the door close cycle.

Figure 6:
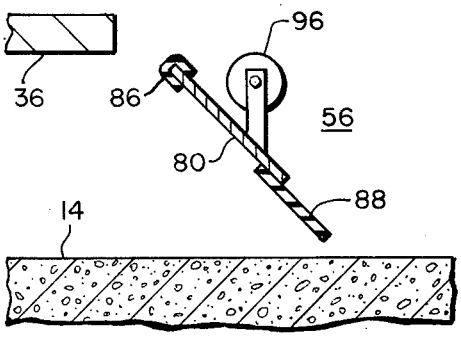
FIG. 6 is a plan view of a side shield member in its retracted position, taken between and in the direction of arrows VI—VI of FIG. 2.
Figure 7:
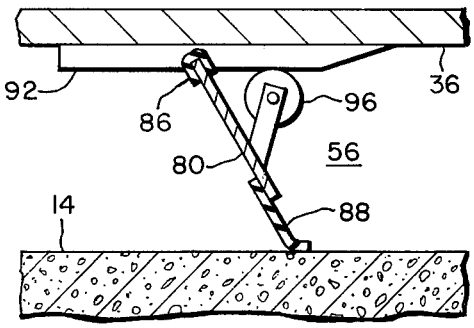
FIG. 7 is a plan view of the side shield member shown in FIG. 6, in its extended or sealing position, taken between and in the direction of arrows VII—VII of FIG. 3.

FIG. 6 is a plan view, in section, of the third shield member 56 taken between and in the direction of arrows VI—VI of FIG. 2. Thus, FIG. 6 illustrates the third shield member 56 in its unactuated position, biased towards the elevator car 12 to provide the desired running clearance between the second and third shield members and the external wall 14 of the building. FIG. 7 is a plan view, in section, of the third shield member 56 taken between and in the direction of arrows VII—VII of FIG. 3, illustrating the third shield member 56 in its actuated position, cammed against the external wall 14 such that the elastomeric flap 88 contacts the wall 14 and is stressed and deflected to include a flap portion snugly in contact with the wall.

The fourth shield member 58 may be similar in construction to the first shield member 52, including first and second flat elongated metallic leg members 100 and 102 joined by a hinge 104 having a horizontally oriented pivot axis. An elastomeric flap 106 is secured to the second leg member 102 of the hinge apparatus, such as via a plurality of screws 108.

First and second pivotable actuator assemblies 110 and 112 are mounted from the car sill 84 at the left and right hand sides of the car 12 as viewed in FIGS. 2 and 3, which actuator assemblies are actuated by cam members 114 and 116, respectively. Cam members 114 and 116 are secured to the door panels 34 and 36, respectively, such that they will contact and actuate the actuator assemblies 110 and 112 and pivot or flip the fourth shield member 58 to its actuated or sealing position at the desired point during the door opening sequence. In a preferred embodiment of the invention, the fourth shield member 58 is actuated to its sealing position in the door opening cycle, after the second and third shield members have been actuated, and it is returned to its retracted position before the first, second, and third shield members are returned to their unactuated or retracted positions.

Each of the actuator assemblies, such as assembly 112, includes a pivotally mounted arm 120 mounted on a pivot pin 122 whose axis is horizontally oriented, perpendicular to the front of the elevator car 12 and the exterior wall 14 of the building 16. The upper end of the arm 120 includes a roller 124 rotatably mounted thereon for cooperating with the cam 116 fixed to the door panel 36, and the lower end includes a roller 126 rotatably mounted thereon, for cooperation with a cam member 130. Cam member 130 is fixed to the depending portion of the fourth shield member 58 such as to the metallic member 105. A similar cam member 132 is fixed to the depending portion of the fourth shield member 58 for cooperation with the actuator assembly 110.

Figure 8:
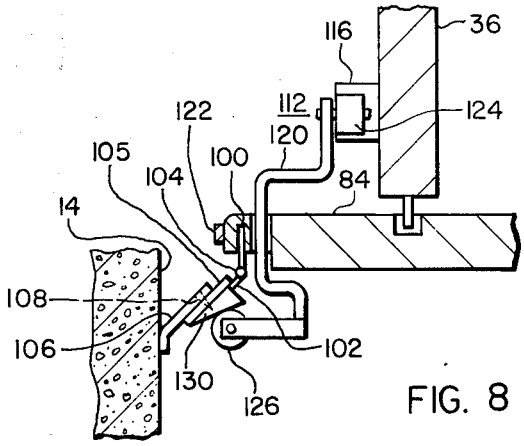
FIG. 8 is an elevational view of the bottom shield member operated to its extended or sealing position, taken between and in the direction of arrows VIII—VIII of FIG. 3.

FIG. 8 is an elevational view, in section, of the fourth shield member 58 taken between and in the direction of arrows VIII—VIII of FIG. 3, illustrating the actuator arm 120 being pivoted by cam 116 such that roller 126 engages cam 130 to lift the flap and effect the seal below the door opening. When the elevator car doors are closing, roller 124 will ride down the cam 116, pivoting arm 120 back towards its starting position causing roller 126 to ride down the incline on cam 130 and allow the flap to retract to its running position. Suitable bias springs (not shown) may be used to bias the flap of the fourth shield member 58 towards the elevator car, to prevent its movement during travel of the elevator car.

As hereinbefore pointed out, the actuation of the four shield members by the car doors permits sequential operation of the flaps, and in a preferred embodiment of the invention the first shield member is actuated to its sealing position first during a door close cycle, the second and third flap members are then simultaneously operated to their sealing positions, and finally the fourth shield member is actuated to its sealing position. Upon door closure, the reverse sequence is automatically effected.

In summary, the present invention is a new and improved elevator system in which the running clearance between the elevator car and hoistway wall is automatically closed by precipitation and wind shield apparatus, completely surrounding the car door and hoistway door openings. This seal is automatically accomplished and automatically terminated, in response to movement of the elevator car doors, providing many advantages over prior art sealing arrangements. For example, the building wall is not modified in the present invention, as the components of the sealing apparatus are entirely car mounted. There is no sliding contact between elements as the elevator car moves in the hoistway, and thus wear is not a problem. The seal is not effected by a rectilinear extension of sealing components, but by a pivotal action, and thus alignment and binding problems are eliminated. The motive power for actuating and deactuating the seal comes entirely from car door movement. Auxiliary electrical circuits, solenoids, and the like are completely eliminated. Finally, auxiliary electrical interlock circuits to prevent car movement while the seal is effected are completely unnecessary. Since the seal is door actuated, all of the normal door interlock circuits completely protect the components of the sealing function.

I claim as my invention:

1. An elevator system, comprising:

an elevator car including an opening having first and second sides and top and bottom portions, and door means mounted on said elevator car for horizontal movement to open and close said opening;

a building having a plurality of floors, and door means located at certain of the floors to provide access to the floors through an external wall of the building;

means mounting said elevator car for movement adjacent to but spaced from said external wall, with the door means of a floor being in registry with and operable by the door means of the elevator car when the elevator car is stopped at the floor;

and sealing means carried by said elevator car, said sealing means including first means mechanically and pivotably actuatable between first and second positions by horizontal movement of the door means of said elevator car as it opens and closes the opening in said elevator car, with the first position being a retracted position, and with the second position being an extended position which closes and seals the space above the top portion of the car opening, between the elevator car and the external wall of the building.

2. The elevator system of claim 1 wherein the first means includes a shield member pivotally mounted on the elevator car on a horizontally oriented pivot axis, and means carried by the door means of the elevator car for contacting and pivoting the shield member between the first and second positions.

3. An elevator system, comprising:

an elevator car including an opening having first and second sides and top and bottom portions, and door means mounted for movement to open and close said opening;

a building having a plurality of floors, and door means located at certain of the floors to provide access to the floors through an external wall of the building;

means mounting said elevator car for movement adjacent to but spaced from said external wall, with the door means of a floor being in registry with and operable by the door means of the elevator car when the elevator car is stopped at the floor;

and sealing means carried by said elevator car, said sealing means including first, second, and third means each mechanically actuatable between first and second positions by movement of the door means of the elevator car as it opens and closes the opening in the elevator car, with the first position being a retracted position and the second position being an extended position, said extended position of the first, second and third means closing the space adjacent to the top portion and first and second sides, respectively, of the opening in the elevator car, between the elevator car and the external wall of the building.

4. The elevator system of claim 3 wherein the second and third means each include a shield member pivotally mounted on the elevator car on vertically oriented pivot axes, and means carried by the door means of the elevator car for contacting and pivoting the shield members of the second and third means between the first and second positions.

5. The elevator system of claim 3 wherein the door means of the elevator car, during its opening movement, actuates the first means to its second position prior to actuating the second and third means to their second positions, and during its closing movement, it actuates the second and third means back to their first positions prior to actuating the first mens back to its first position.

6. The elevator system of claim 3 wherein the sealing means includes fourth means mechanically actuatable between first and second positions by movement of the door means of the elevator car as its opens and closes the opening in the elevator car, with the first position being a retracted position, and with the second position being an extended position which closes the space below the bottom portion of the elevator car opening, between the elevator car and the external wall of the building.

7. The elevator system of claim 6 wherein the fourth means includes a shield member pivotally mounted on the elevator car on a horizontally oriented pivot axis, and means carried by the door means of the elevator car for contacting and pivoting the shield member between the first and second positions.

8. The elevator system of claim 6 wherein the door means of the elevator car, during its opening movement, sequentially closes the space above, laterally, and below the opening in the elevator car in the recited order, and, during its closing movement it sequentially opens the spaces in the reverse order.

* * * * *